US010570761B2

(12) United States Patent
Green et al.

(10) Patent No.: US 10,570,761 B2
(45) Date of Patent: Feb. 25, 2020

(54) STATOR VANE ARRANGEMENT AND A METHOD OF CASTING A STATOR VANE ARRANGEMENT

(71) Applicant: ROLLS-ROYCE plc, London (GB)

(72) Inventors: Richard R. Green, Derby (GB); David Bexton, Derby (GB)

(73) Assignee: ROLLS-ROYCE plc, London (GB)

( * ) Notice: Subject to any disclaimer, the term of this patent is extended or adjusted under 35 U.S.C. 154(b) by 317 days.

(21) Appl. No.: 15/623,992

(22) Filed: Jun. 15, 2017

(65) Prior Publication Data

US 2018/0003066 A1 Jan. 4, 2018

(30) Foreign Application Priority Data

Jun. 30, 2016 (GB) ..... 1611372.2

(51) Int. Cl.
*F01D 5/18* (2006.01)
*F01D 9/04* (2006.01)
(Continued)

(52) U.S. Cl.
CPC ..... *F01D 9/041* (2013.01); *F01D 9/065* (2013.01); *F01D 21/003* (2013.01);
(Continued)

(58) Field of Classification Search
CPC ..... F01D 9/041; F01D 9/065; F01D 21/003; F01D 25/162; F01D 25/18;
(Continued)

(56) References Cited

U.S. PATENT DOCUMENTS 2,919,888 A * 1/1960 Simmons ..... F01D 9/065 384/428
3,084,849 A * 4/1963 Dennison ..... F04D 29/0563 415/115
(Continued)

FOREIGN PATENT DOCUMENTS

EP 392664 10/1990
FR 2976616 6/2011
(Continued)

OTHER PUBLICATIONS

Heat Transfer Research Services, Internal Air and Lubrication Systems, 2010, Encyclopedia of Aerospace Engineering, Internal Air and Lubrication Systems, p. 1 (Year: 2010).*
(Continued)

*Primary Examiner* — Nathaniel E Wiehe
*Assistant Examiner* — Andrew J Marien
(74) *Attorney, Agent, or Firm* — Simpson & Simpson, PLLC

(57) ABSTRACT

A stator vane arrangement for a turbomachine comprises a radially inner annular structure, a radially outer annular structure and a plurality of circumferentially spaced vanes extending radially between the inner annular structure and the outer annular structure. At least one of the vanes has a passage extending from the inner annular structure to the outer annular structure. The inner annular structure has at least one radially inwardly extending boss and each boss has a passage extending there-through. The passage in each boss is aligned with a corresponding passage in a vane. Each boss comprises a first portion having a first cross-sectional area and a second portion having a second cross-sectional area which is greater than the first cross-sectional area. The first portion of each boss is positioned between and intercon-
(Continued)

necting the second portion of the boss and the inner annular structure.

20 Claims, 4 Drawing Sheets

(51) Int. Cl.
*F01D 9/06* (2006.01)
*F01D 21/00* (2006.01)
*F01D 25/16* (2006.01)
*F01D 25/18* (2006.01)

(52) U.S. Cl.
CPC ..... *F01D 25/162* (2013.01); *F01D 25/18* (2013.01); *F05D 2220/32* (2013.01); *F05D 2230/21* (2013.01); *F05D 2240/60* (2013.01); *F05D 2300/10* (2013.01); *F05D 2300/20* (2013.01)

(58) Field of Classification Search
CPC ..... F05D 2220/32; F05D 2230/31; F05D 2240/60; F05D 2300/10; F05D 2300/20
See application file for complete search history.

(56) References Cited

U.S. PATENT DOCUMENTS 4,304,522 A * 12/1981 Newland ..... F01D 25/162 415/135
4,487,246 A * 12/1984 Frasier ..... B22C 21/14 164/122.2
4,972,671 A * 11/1990 Asselin ..... F01D 9/065 184/6.11
5,080,555 A * 1/1992 Kempinger ..... F01D 9/065 415/108
6,227,798 B1 5/2001 Demers et al.
6,425,241 B1 * 7/2002 Jones ..... F01D 9/02 60/803
6,431,824 B2 * 8/2002 Schotsch ..... F01D 9/02 415/115
7,730,715 B2 6/2010 Grudnoski et al.
10,006,306 B2 * 6/2018 Scott ..... F01D 9/065
10,087,847 B2 * 10/2018 Szymanski ..... F01D 9/065
2010/0275572 A1 * 11/2010 Durocher ..... F01D 9/065 60/39.08
2012/0321451 A1 * 12/2012 Xiao ..... F01D 9/041 415/180
2014/0003920 A1 * 1/2014 Scott ..... F01D 9/065 415/177
2014/0135134 A1 * 5/2014 Duchatelle ..... F01D 9/065 464/183
2014/0356132 A1 * 12/2014 Leroux ..... G01H 1/006 415/118
2015/0081121 A1 * 3/2015 Morgan ..... F01D 21/003 700/287
2015/0308344 A1 * 10/2015 Vo ..... F01D 9/065 415/213.1
2016/0169032 A1 * 6/2016 Porter ..... F01D 21/003
2016/0208647 A1 * 7/2016 Cherolis ..... F01D 9/065
2016/0222827 A1 * 8/2016 Winn ..... F02C 7/12
2016/0230598 A1 * 8/2016 Cherolis ..... F01D 9/065

FOREIGN PATENT DOCUMENTS

GB 1455608 11/1976
WO 2013126471 8/2013
WO 2014105425 7/2014
WO 2014105619 7/2014
WO 2014105688 7/2014
WO 2014105716 7/2014
WO 2014204608 12/2014

OTHER PUBLICATIONS

The Basics of Metal Casting, Apr. 19, 2012, The Library of Manufacturing (Year: 2012).*
Great Britain Search Report dated Dec. 6, 2016 issued in GB Patent Application No. 1611372.2.

* cited by examiner

STATOR VANE ARRANGEMENT AND A METHOD OF CASTING A STATOR VANE ARRANGEMENT

CROSS-REFERENCE TO RELATED APPLICATIONS

This application is based upon and claims the benefit of priority from British Patent Application Number 1611372.2 filed 30 Jun. 2016, the entire contents of which are incorporated by reference.

BACKGROUND

1. Field of Disclosure

The present disclosure concerns a stator vane arrangement and a method of casting a stator vane arrangement and in particular concerns a stator vane arrangement for a turbomachine and a method of casting a stator vane arrangement for a turbomachine.

2. Description of the Related Art

Turbomachines, e.g. gas turbine engines, have one or more stator vane arrangements to support bearing housings and associated bearings of the turbomachine. In a turbofan gas turbine engine one of these stator vane arrangements supports a bearing housing and associated bearings for a fan shaft and/or a compressor shaft of the turbofan gas turbine engine. This stator vane arrangement is sometimes known as an engine section stator. The radially inner annular structure is secured to the bearing housing and the radially outer annular structure is secured to the fan outlet guide vanes and hence to the fan casing. The stator vane arrangement comprises a radially inner annular structure, a radially outer annular structure and a plurality of circumferentially spaced vanes extending radially between the radially inner annular structure and the radially outer annular structure. A radially inner surface of the radially outer annular structure and a radially outer surface of the radially inner annular structure define the flow path from the fan to the compressor, or compressors, of the core engine of the turbofan gas turbine engine.

It is known to produce this stator vane arrangement by individually forging, casting or otherwise forming the vanes and welding the stator vanes together. It is also known to produce this stator vane arrangement by investment casting the stator vane arrangement as a single integral, or monolithic, structure and machining.

A cast stator vane arrangement comprising a single integral structure is cheaper to produce and may have reduced weight.

The stator vane arrangement has hollow vanes which have passages to enable lubricant to be supplied to and removed from the associated bearings in the bearing housing and to enable air to be vented from the associated bearings. Hollow bosses on a radially inner surface of the radially inner annular wall enable pipes to supply lubricant out of, lubricant into or air into the hollow vanes. The hollow vanes are produced using ceramic cores during the investment casting process.

However, the provision of the bosses on the radially inner surface of the radially inner annular wall has several problems. It is difficult to control the positions of the bosses relative to the ceramic cores which may result in reduced thickness of the walls of the bosses around the passage after casting and final machining. There is a difference in the thickness between the majority of the radially inner annular wall and the thickness of the radially inner annular wall in the regions of the bosses. During the solidification of the molten metal during the casting process the molten metal in the thinner regions cools quicker than the molten metal in the thicker regions and hence dimples, a process known as "hip-sinkage", are formed in the radially outer surface of the radially inner annular structure in the regions of the bosses and this requires additional machining to provide the correct shape for the radially outer surface of the radially inner annular structure.

OBJECTS AND SUMMARY

According to a first aspect of the present disclosure there is provided a stator vane arrangement comprising a radially inner annular structure, a radially outer annular structure and a plurality of circumferentially spaced vanes extending radially between the radially inner annular structure and the radially outer annular structure, at least one of the vanes having a passage extending there-through from the radially inner annular structure to the radially outer annular structure, the radially inner annular structure having at least one boss extending radially inwardly there-from, the at least one boss having a passage extending there-through, the passage in the at least one boss being aligned with the passage in the at least one vane, the at least one boss comprising a first portion having a first cross-sectional area and a second portion having a second cross-sectional area which is greater than the first cross-sectional area, and the first portion of the boss being positioned between and interconnecting the second portion of the boss and the radially inner annular structure.

A plurality of vanes may have a passage extending there-through from the radially inner annular structure to the radially outer annular structure, the radially inner annular structure having a plurality of bosses extending radially inwardly there-from, each boss having a passage extending there-through, the passage in each boss being aligned with a passage in a respective one of the vanes, each boss comprising a first portion having a first cross-sectional area and a second portion having a second cross-sectional area which is greater than the first cross-sectional area, and the first portion of each boss being positioned between and interconnecting the second portion of the boss and the radially inner annular structure.

The or each boss may have at least one support structure to support the boss, the at least one support structure extending radially from the second portion of the boss to the radially inner annular structure and the at least one support structure being connected to the first portion of the boss.

The or each boss may have a plurality of support structures to support the boss, each support structure extending radially from the second portion of the boss to the radially inner annular structure and each support structure being connected to the first portion of the boss.

According to a second aspect of the present discourse there is provided a turbomachine comprising a stator vane arrangement as described in any one of the previous four paragraphs.

The turbomachine may have a bearing housing secured to the radially inner annular structure and at least one bearing being arranged within the bearing housing.

A lubricant supply may be arranged to supply lubricant through the passage through the at least one stator vane from the radially outer annular structure to the radially inner annular structure.

A pipe may be arranged to supply lubricant from the at least one boss to at least one bearing within the bearing housing.

A lubricant collector may be arranged to supply collected lubricant through the passage through the at least one stator vane from the radially inner annular structure to the radially outer annular structure.

A pipe may be arranged to supply lubricant to the at least one boss from at least one bearing within the bearing housing.

An air collector may be arranged to supply collected air through the passage through the at least one stator vane from the radially inner annular structure to the radially outer annular structure.

A pipe may be arranged to supply air to the at least one boss from at least one bearing within the bearing housing.

An electrical cable may extend through the passage through the at least one stator vane from the radially inner annular structure to the radially outer annular structure.

The electrical cable may be arranged to supply an electrical signal from a speed probe.

The at least one bearing may rotatably mount a shaft of the turbomachine.

The turbomachine may be a gas turbine engine.

The gas turbine engine may be an aero gas turbine engine, a marine gas turbine engine, an industrial gas turbine engine or an automotive gas turbine engine. The aero gas turbine engine may be a turbofan gas turbine engine, a turbojet gas turbine engine, a turbo-shaft gas turbine engine or a turbo-propeller gas turbine engine.

The gas turbine engine may be a turbofan gas turbine engine and the shaft is a fan shaft.

According to a third aspect of the present disclosure there is provided a method of casting a stator vane arrangement comprising a radially inner annular structure, a radially outer annular structure and a plurality of circumferentially spaced vanes extending radially between the radially inner annular structure and the radially outer annular structure, at least one of the vanes having a passage extending there-through from the radially inner annular structure to the radially outer annular structure, the radially inner annular structure having at least one boss extending radially inwardly there-from, the at least one boss having a passage extending there-through, the passage in the at least one boss being aligned with the passage in the at least one vane, the at least one boss comprising a first portion having a first cross-sectional area and a second portion having a second cross-sectional area which is greater than the first cross-sectional area, and the first portion of the boss being positioned between and interconnecting the second portion of the boss and the radially inner annular structure, the method comprising producing a wax pattern of the radially inner annular structure, the radially outer annular structure and the plurality of circumferentially spaced vanes, providing a ceramic core in the wax pattern of at least one of the vanes, the ceramic core extending through the wax radially inner annular wall, providing a wax boss on the radially inner end of the ceramic core, the wax boss comprising a first portion having a first cross-sectional area and a second portion having a second cross-sectional area which is greater than the first cross-sectional area, and the first portion of the wax boss being positioned between and interconnecting the second portion of the wax boss and the wax radially inner annular structure, depositing a ceramic material on the wax pattern to form a ceramic mould, removing the wax from the ceramic mould, pouring molten metal into the ceramic mould, solidifying the molten metal within the ceramic mould to form the stator vane arrangement and removing the ceramic mould and ceramic core from the stator vane arrangement.

The method may comprises providing a ceramic core in the wax pattern of a plurality of vanes, each ceramic core extending through the wax radially inner annular wall, providing a wax boss on the radially inner end of each ceramic core, each wax boss comprising a first portion having a first cross-sectional area and a second portion having a second cross-sectional area which is greater than the first cross-sectional area, and the first portion of the wax boss being positioned between and interconnecting the second portion of the wax boss and the wax radially inner annular structure, depositing a ceramic material on the wax pattern to form a ceramic mould, removing the wax from the ceramic mould, pouring molten metal into the ceramic mould, solidifying the molten metal within the ceramic mould to form the stator vane arrangement and removing the ceramic mould and the ceramic cores from the stator vane arrangement.

The method may comprise providing at least one wax support structure to support each boss, the at least one wax support structure extending radially from the second portion of the wax boss to the wax radially inner annular structure and the at least one wax support structure being connected to the first portion of the wax boss.

The or each boss may have a plurality of wax support structures to support the wax boss, each wax support structure extending radially from the second portion of the wax boss to the wax radially inner annular structure and each wax support structure being connected to the first portion of the wax boss.

The metal may be a titanium alloy, steel or a nickel alloy.

The skilled person will appreciate that except where mutually exclusive, a feature described in relation to any one of the above aspects of the disclosure may be applied mutatis mutandis to any other aspect of the disclosure.

BRIEF DESCRIPTION OF THE DRAWINGS

Embodiments of the disclosure will now be described by way of example only, with reference to the Figures, in which.

DETAILED DESCRIPTION OF EMBODIMENTS

Figure 1:
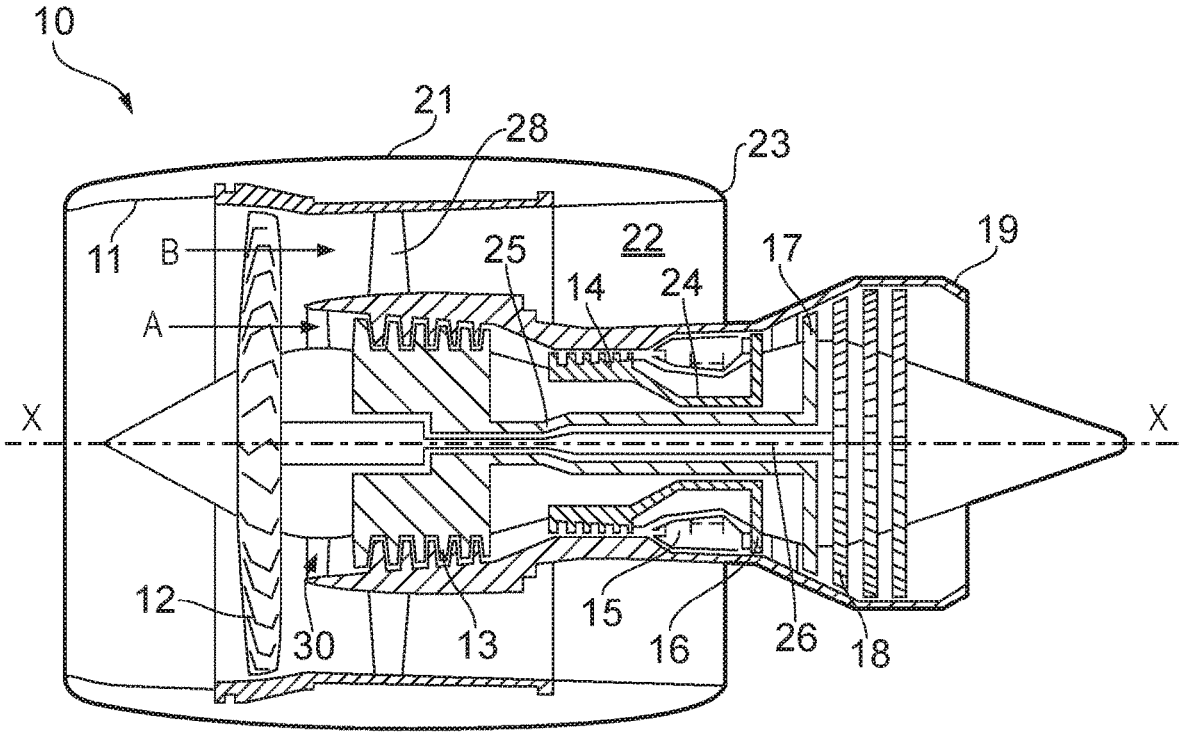
FIG. 1 is a cross-sectional view through a turbofan gas turbine engine having a stator vane arrangement according to the present disclosure.

With reference to FIG. 1, a gas turbine engine is generally indicated at 10, having a principal and rotational axis X. The engine 10 comprises, in axial flow series, an air intake 11, a propulsive fan 12, an intermediate pressure compressor 13, a high-pressure compressor 14, combustion equipment 15, a high-pressure turbine 16, and intermediate pressure turbine 17, a low-pressure turbine 18 and an exhaust nozzle 19. A nacelle 21 generally surrounds the engine 10 and defines the intake 11, a bypass duct 22 and a bypass exhaust nozzle 23.

The gas turbine engine 10 works in the conventional manner so that air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow directed into it before delivering that air to the high pressure compressor 14 where further compression takes place. The nacelle 21 is generally supported from the core engine by a plurality of circumferentially spaced radially extending fan outlet guide vanes 28.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high 16, intermediate 17 and low 18 pressure turbines drive respectively the high pressure compressor 14, intermediate pressure compressor 13 and fan 12, each by a suitable interconnecting shaft 24, 25 and 26 respectively.

The turbofan gas turbine engine 10 also comprises one or more stator vane arrangements to support bearing housings and associated bearings of the turbofan gas turbine engine. The turbofan gas turbine engine 10 has a stator vane arrangement 30 to support a bearing housing 32 which has an associated bearing 34 for the shaft 26 arranged to drive the fan 12 and an associated bearing 36 for the shaft 25 arranged to drive the intermediate pressure compressor 13 of the turbofan gas turbine engine 10. This stator vane arrangement 30 is sometimes known as an engine section stator. The bearings 34 and 36 may be roller bearings or ball bearings. The shaft 25 is secured to a disc 27 of the intermediate pressure compressor 13.

The stator vane arrangement 30 is shown more clearly in FIGS. 2 to 6 and comprises a radially inner annular structure 38, a radially outer annular structure 40 and a plurality of circumferentially spaced vanes 42 extending radially between and secured to the radially inner annular structure 38 and the radially outer annular structure 40. The radially inner annular structure 38 is secured to the bearing housing 32 and the radially outer annular structure 40 is secured to the fan outlet guide vanes 28 and hence to the nacelle 21. A radially outer surface 39 of the radially inner annular structure 38 and a radially inner surface 41 of the radially outer annular structure 40 define the flow path for the first air flow A from the fan 12 to the intermediate pressure compressor 13 and thence to the high pressure compressor 14 of the core engine of the turbofan gas turbine engine 10. The vanes 42 may be aerodynamically shaped to supply the first air flow A to the intermediate pressure compressor 13. The radially inner annular structure 38 comprises a first frustoconical panel 44 and a second frustoconical panel 46 spaced axially from the first frustoconical panel 44 which extend radially inwardly from the radially inner annular structure 38. The first frustoconical panel 44 is secured to a first annular panel 48 extending radially outwardly from an axially upstream end of the bearing housing 32 for example by welding, e.g. by electron beam welding in a partial vacuum, and the second frustoconical panel 46 is secured to a second annular panel 50 extending radially outwardly from an axially downstream end of the bearing housing 32 for example by welding, e.g. by electron beam welding in a partial vacuum. The radially outer annular structure 40 comprises an annular flange 47 which extends radially outwardly from the radially outer annular structure 40 and the fan outlet guide vanes 28 are secured to the annular flange 47. The fan outlet guide vanes 28 are secured to the annular flange 47 by fasteners, e.g. nuts and bolts.

Each vane 42 has a leading edge 42A, a trailing edge 42B, a convex suction surface 42C extending from the leading edge 42A to the trailing edge 42B and a concave pressure surface 42D extending from the leading edge 42A to the trailing edge 42B.

Figure 3:
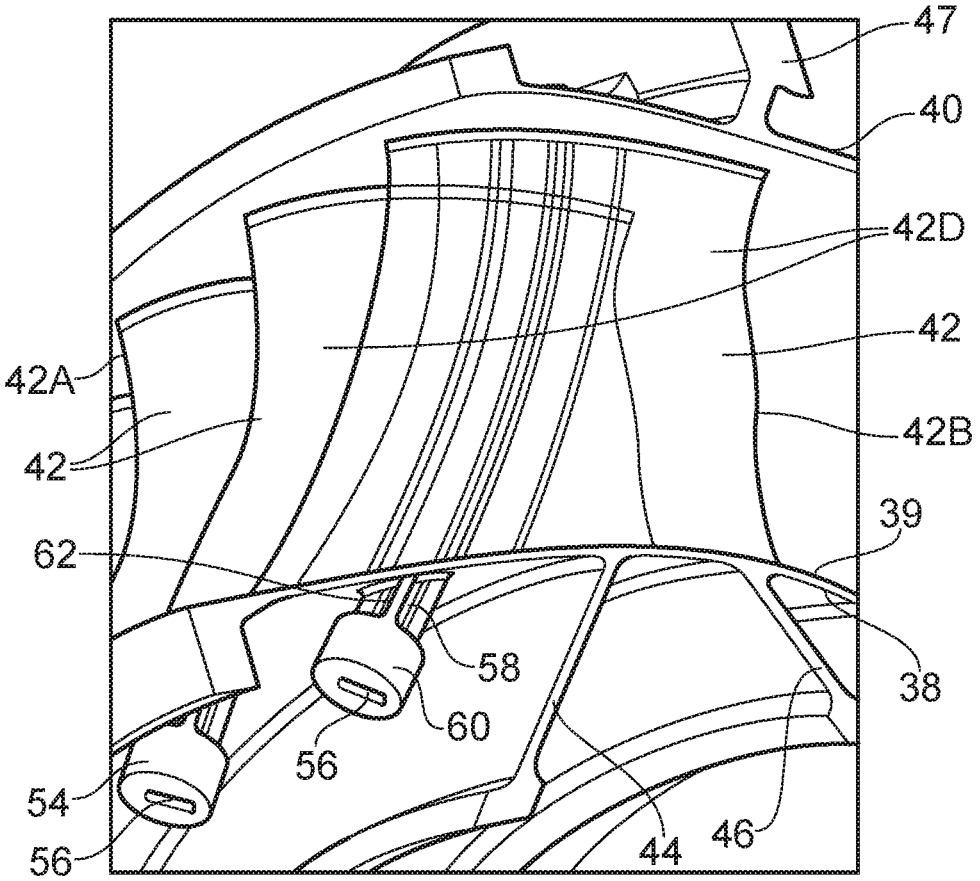
FIG. 3 is a further enlarged perspective view of part of the stator vane arrangement shown in FIG. 2.
Figure 4:
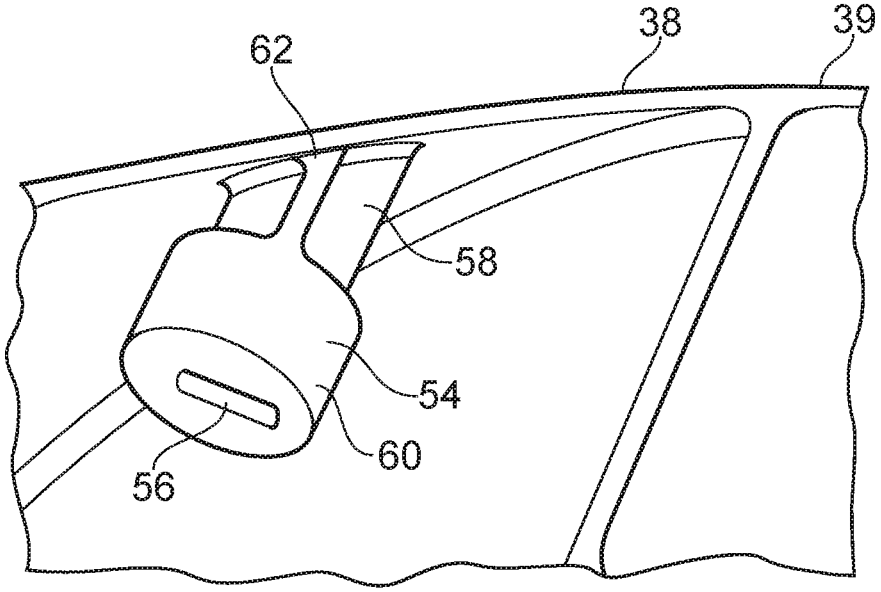
FIG. 4 is a further enlarged perspective view of a boss of the stator vane arrangement shown in FIG. 3.
Figure 5:
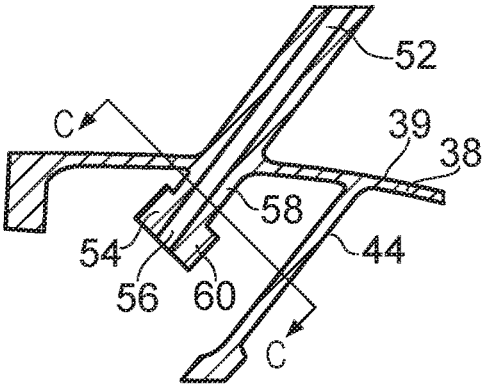
FIG. 5 is a cross-sectional view a portion of a stator vane and a boss of the stator vane arrangement shown in shown in FIG. 3.
Figure 6:
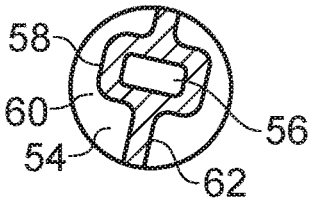
FIG. 6 is a cross-sectional view in the direction of arrows C-C in FIG. 5.

A plurality of the vanes 42 each have a passage 52 extending there-through from the radially inner annular surface of the radially inner annular structure 40 to the radially outer surface of the radially outer annular structure 38 and the radially inner annular structure 38 has a plurality of circumferentially spaced bosses 54 extending radially inwardly there-from from the radially inner surface of the radially inner annular structure 38. Each boss 54 has a passage 56 extending there-through and the passage 56 in each boss 54 is aligned with a passage 52 in a respective one of the vanes 42. Each boss 54 comprises a first portion 58 which has a first cross-sectional area and a second portion 60 which has a second cross-sectional area which is greater than the first cross-sectional area. The first portion 58 of each boss 54 is positioned between and interconnects the second portion 60 of the boss 54 and the radially inner annular structure 38. Each boss 54 has at least one support structure 62 to support the boss 54 and the at least one support structure 62 extends radially from the second portion 60 of the boss 54 to the radially inner annular structure 38 and the at least one support structure 62 is connected to the first portion 58 of the boss 54. In this particular example each boss 54 has a plurality of support structures 62 to support the boss 54 and each support structure 62 extends radially from the second portion 60 of the boss 54 to the radially inner annular structure 38 and each support structure 62 is connected to the first portion 58 of the boss 54. The first portion 58 of each boss 54 forms a first section of a wall around the passage 56 through the boss 54 and the second portion 60 of each boss 54 forms a second section of the wall around the passage 56 though the boss 54 and the second section of the wall around the passage 56 is thicker than the first section of the wall around the passage 56 as shown in FIG. 6. The second portion 60 of each boss 54 is generally annular in cross-section and the first portion 58 of each boss 54 has a generally annular cross-sectional shape to correspond with the shape of the ceramic core 52. The first portion 58 has a cross-sectional shape with generally rectangular inner and outer surfaces with rounded corners, as shown in FIG. 6, to correspond with the shape of the ceramic core 52. The second portion 60 of each boss 54 has a cross-sectional shape with a circular outer surface and a generally rectangular inner surface with rounded corners, as shown in FIGS. 3 and 4, to correspond with the shape of the ceramic core 52. However, the first portion 58 of each boss 54 may have a cross-sectional shape with circular inner and outer surfaces to correspond with a circular cross-section ceramic core 52 and the second portion 60 of each boss 54 may have a cross-sectional shape with circular inner and outer surfaces to correspond with a circular cross-section ceramic core 52.

A lubricant supply (not shown) is arranged to supply lubricant through the passage 52 through at least one of the stator vanes 42 from the radially outer annular structure 40 to the radially inner annular structure 40. The lubricant then flows through the passage 56 within the associated boss 54. A pipe 64 is arranged to supply lubricant from the passage 56 within the associated boss 54 to the bearings 34 and 36 within the bearing housing 32. In one particular example lubricant is supplied through the passage 52 through two of the stator vanes 42 from the radially outer annular structure 40 to the radially inner annular structure 40. The lubricant then flows through the passage 56 within the associated bosses 54. Two pipes 64 are arranged to supply lubricant from the passages 56 within the associated bosses 54 to the bearings 34 and 36 within the bearing housing 32.

A lubricant collector (not shown) within the bearing housing 32 is arranged to supply collected lubricant through the passage 52 through at least one of the stator vanes 42 from the radially inner annular structure 38 to the radially outer annular structure 40. A pipe 66 is arranged to supply lubricant collected from the bearings 34 and 36 within the bearing housing 32 from the lubricant collector to at least one boss 54. The lubricant then flows through the passage 56 within the at least one boss 54 and then through the passage 52 through at least one of the stator vanes 42 from the radially inner annular structure 38 to the radially outer annular structure 40 and the lubricant is returned to the lubricant supply. In one particular example two pipes 66 are arranged to supply lubricant collected from the bearings 34 and 36 within the bearing housing 32 from the lubricant collector to two bosses 54. The lubricant then flows through the passage 56 within the two bosses 54 and then through the passages 52 through two of the stator vanes 42 from the radially inner annular structure 38 to the radially outer annular structure 40 and the lubricant is returned to the lubricant supply.

An air collector (not shown) within the bearing housing 32 is arranged to supply collected air through the passage 52 through the at least one stator vanes 42 from the radially inner annular structure 38 to the radially outer annular structure 40. A pipe 68 is arranged to supply air collected from the bearings 34 and 36 within the bearing housing 32 to at least one boss 54. The air then flows through the passage 56 within the at least one boss 54 and then through the passage 52 through at least one of the stator vanes 42 from the radially inner annular structure 38 to the radially outer annular structure 40 to allow excess pressure in the bearing chamber, e.g. air, to be vented overboard via an oil air separator. In one particular example three pipes 68 are arranged to supply air from the bearings 34 and 36 within the bearing housing 32 to three bosses 54. The air then flows through the passage 56 within the three bosses 54 and then through the passages 52 through three of the stator vanes 42 from the radially inner annular structure 38 to the radially outer annular structure 40 to allow excess pressure in the bearing chamber, e.g. air, to be vented overboard via an oil air separator.

An electrical cable 70A, 70B extends through the passage 52 through at least one of the stator vanes 42 from the radially inner annular structure 38 to the radially outer annular structure 40. The electrical cable 70A, 70B is arranged to supply an electrical signal from a speed probe 72A, 72B, which is arranged to measure the speed of rotation of the shaft 26 or the shaft 25. The electrical cable 70A, 70B extends through the passage 56 within at least one boss 54 and then through the passage 52 through at least one of the stator vanes 42 from the radially inner annular structure 38 to the radially outer annular structure 40 and the electrical cable 70A, 70B is connected to an engine control unit. In one particular example two speed probes 72A (Only one shown) measure the speed of the shaft 26 and two speed probes 72B (Only one shown) measure the speed of the shaft 25. Two electrical cables 70A extends through the passages 56 within two bosses 54 and then through the passages 52 through two of the stator vanes 42 from the radially inner annular structure 38 to the radially outer annular structure 40 and the electrical cables 70A are connected to the engine control unit and two electrical cables 70B extends through the passages 56 within two bosses 54 and then through the passages 52 through two of the stator vanes 42 from the radially inner annular structure 38 to the radially outer annular structure 40 and the electrical cables 70B are connected to the engine control unit.

The circumferential dimension of the second portion of each boss is greater than that circumferential dimension of the vanes at the radially inner annular structure.

It is to be noted that the stator vane arrangement 30 is an integral structure, a single piece structure or a monolithic structure, e.g. the radially inner annular structure 38, the radially outer annular structure 40, the plurality of circumferentially spaced vanes 42 extending radially between and secured to the radially inner annular structure 38 and the radially outer annular structure 40 and the bosses 54 is an integral structure, a single piece structure or a monolithic structure. The stator vane arrangement 30 is formed by casting.

The advantage of the present disclosure is that the thickness of the radially inner annular structure in the region of each boss has been reduced due to each boss having a first portion with a smaller cross-sectional area. This reduces the weight of the stator vane arrangement. The diameter of the second portion of each boss may be easily adjusted, increased or decreased, to suit the particular application. The angle of each boss relative to the radially inner annular structure may be adjusted. More than one passage, e.g. two or three passages, may be provided in one or more of the vanes and a boss of this type may be provided for each of these passages. The length of the first portion of each boss may be easily adjusted, increased or decreased, to suit the particular application. The thickness of the first portion of each boss may be easily adjusted, increased or decreased, to suit the particular application. The support structures support the bosses to minimise stresses in the bosses and to reduce "chattering" of the machine tool during machining of the bosses. The thickness of each support structures may be easily adjusted, increased or decreased, to vary the amount of support. The number of support structures on each boss may be easily adjusted, increased or decreased, to vary the amount of support.

Although the present disclosure has been described with reference to a stator vane arrangement supporting a bearing housing and associated bearings for a fan shaft and/or a compressor shaft it is equally applicable to a stator vane arrangement supporting a bearing housing and associated bearings for one or more compressor shafts or one or more turbine shafts.

Although the present disclosure has been described with reference to a turbofan gas turbine engine it is equally applicable to a turbojet gas turbine engine, a turbo-shaft gas turbine engine, a turbo-propeller gas turbine engine or other aero gas turbine engine.

Although the present disclosure has been described with reference to an aero gas turbine engine it is equally applicable to a marine gas turbine engine, an industrial gas turbine engine or an automotive gas turbine engine.

Although the present disclosure has been described with reference to a gas turbine engine it is equally applicable to other turbomachines comprising a stator vane arrangement as mentioned above, e.g. steam turbine.

Although the present disclosure has referred to a stator vane arrangement with a plurality of vanes having a passage extending there-through it is equally applicable to a stator vane arrangement in which at least one of the vanes having a passage extending there-through from the radially inner annular structure to the radially outer annular structure, the radially inner annular structure having at least one boss extending radially inwardly there-from, the at least one boss having a passage extending there-through, the passage in the at least one boss being aligned with the passage in the at least one vane, the at least one boss comprising a first portion having a first cross-sectional area and a second portion having a second cross-sectional area which is greater than the first cross-sectional area, and the first portion of the boss being positioned between and interconnecting the second portion of the boss and the radially inner annular structure.

Figure 2:
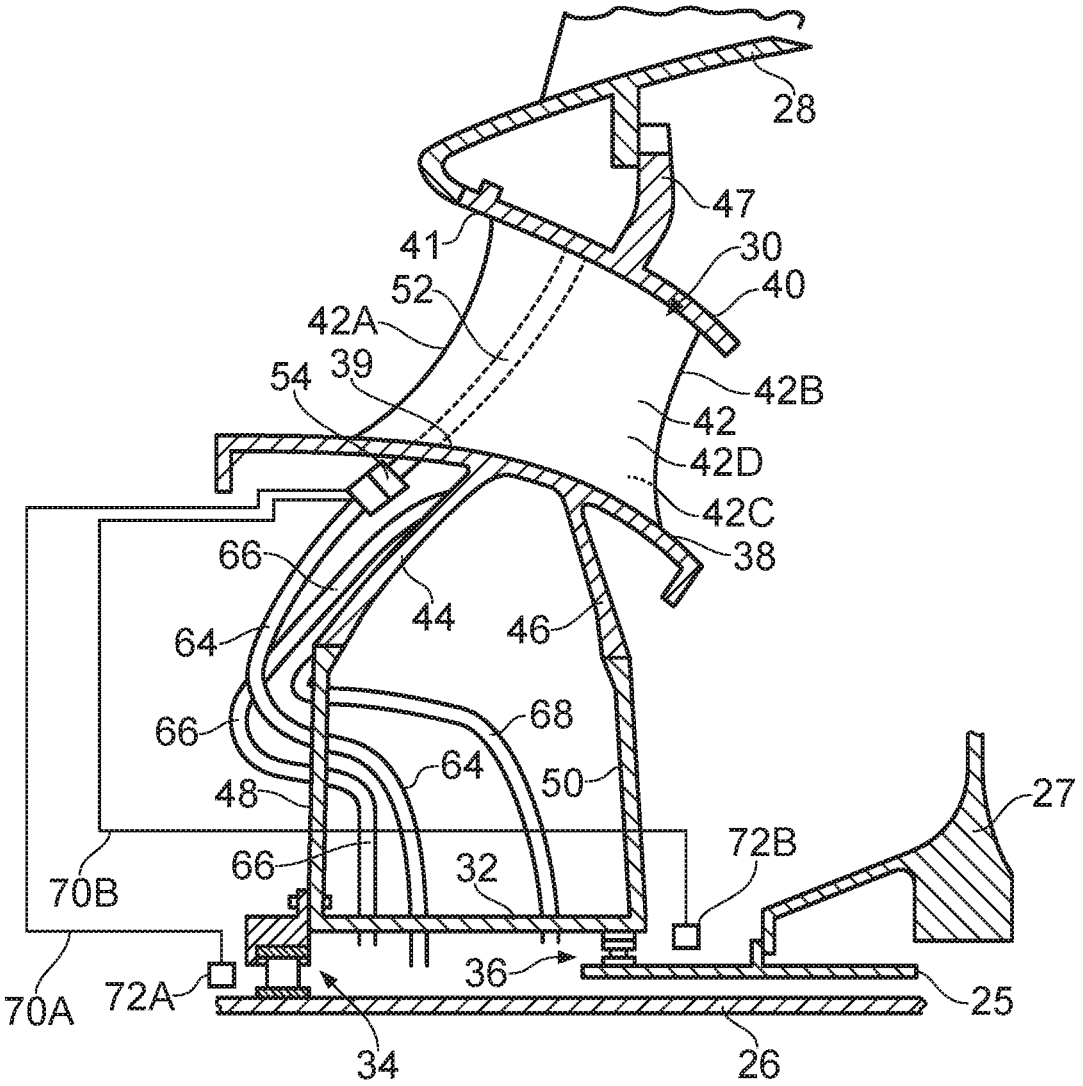
FIG. 2 is an enlarged cross-sectional view of half of an engine section stator, bearings and a bearing housing of the turbofan gas turbine engine shown in FIG. 1 having a stator vane arrangement according to the present disclosure.
Figure 9:
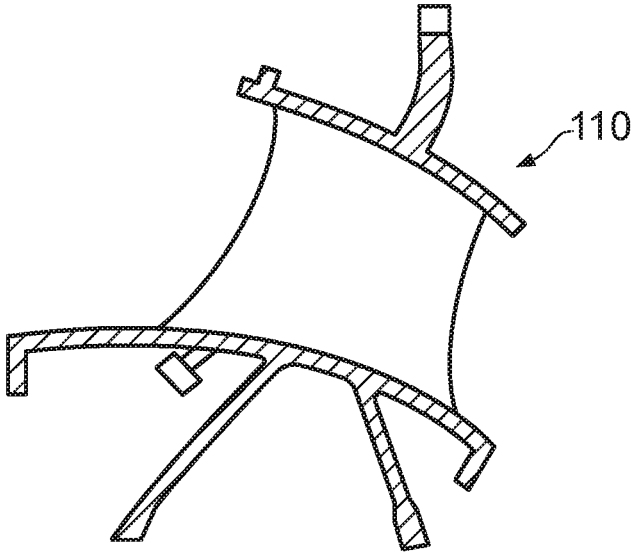
FIG. 9 is a cross-sectional view through half of a cast stator vane arrangement according to the present disclosure.
Figure 7:
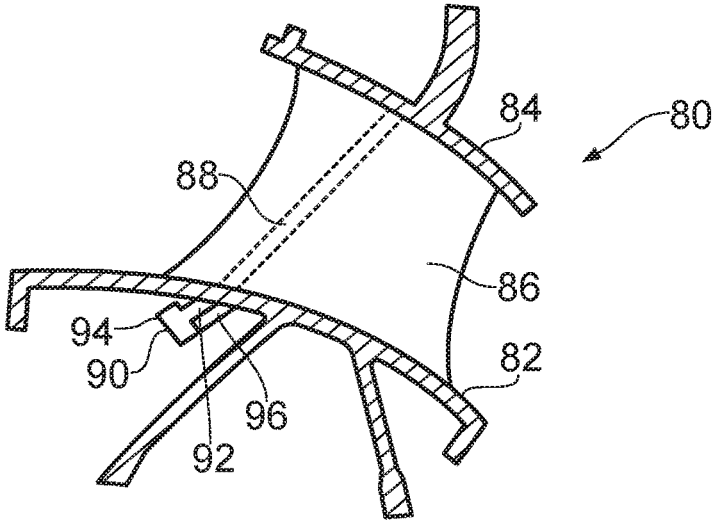
FIG. 7 is a cross-sectional view through half of a wax pattern for casting a stator vane arrangement according to the present disclosure.
Figure 8:
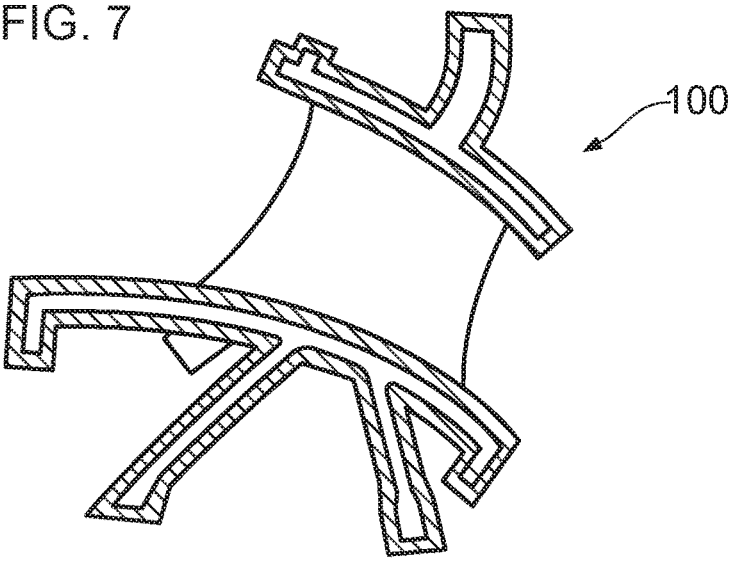
FIG. 8 is a cross-sectional view through half of a ceramic mould for casting a stator vane arrangement according to the present disclosure.

FIGS. 7 to 9 show a method of casting a stator vane arrangement 30 shown in FIGS. 2 to 6. The method comprising producing a wax pattern of the stator vane arrangement 80, the wax pattern comprises a wax radially inner annular structure 82, a wax radially outer annular structure 84 and a plurality of circumferentially spaced wax vanes 86, as shown in FIG. 7. A ceramic core 86 is provided in the wax pattern of a plurality of the wax vanes 86 and each ceramic core 86 extends through the wax radially inner annular structure 82. A wax boss 90 is provided on the radially inner end of each ceramic core 88. Each wax boss 90 comprises a first portion 92 having a first cross-sectional area and a second portion 94 having a second cross-sectional area which is greater than the first cross-sectional area, and the first portion 92 of the wax boss 90 is positioned between and interconnecting the second portion 94 of the wax boss 90 and the wax radially inner annular structure 82. A ceramic material is deposited on the wax pattern of the stator vane arrangement 80 to form a ceramic mould 100, as shown in FIG. 8. The wax is then removed from the ceramic mould 100 for example by heating the mould to melt the wax and by pouring the molten wax out of the ceramic mould 100. Molten metal is supplied, poured, into the ceramic mould 100 and the molten metal is solidified within the ceramic mould 100 to form a cast stator vane arrangement 110 as shown in FIG. 9 and then the ceramic mould 100 and the ceramic cores 88 are removed from the cast stator vane arrangement 110 to form the stator vane arrangement 30 as shown in FIG. 2.

The stator vane arrangement is used as cast. However, it may be necessary for the stator vane arrangement to be finish machined to final shape. The radially outer surface of the radially inner annular structure, the radially inner surface of the radially outer annular structure and the leading edges, trailing edges and the concave and convex surfaces of the vanes may be milled using a six axis milling machine, by milling using other suitable milling machine and/or by mechanical polishing, e.g. grinding and sanding. The surfaces of the passages within the stator vanes and bosses may be aggregate flow polished, also known as abrasive flow machining, by passing an abrasive laden fluid through the passages.

The method comprises providing at least one wax support structure 96 to support each wax boss 90, the at least one wax support structure 96 extends radially from the second portion 94 of the wax boss 90 to the wax radially inner annular structure 82 and the at least one wax support structure 96 is connected to the first portion 92 of the wax boss 90. The or each wax boss 90 has a plurality of wax support structures 96 to support the wax boss 90, each wax support structure 96 extends radially from the second portion of the wax boss 90 to the wax radially inner annular structure 82 and each wax support structure 96 is connected to the first portion 92 of the wax boss 90.

Each wax vane 86 which is to be provided with a passage is provided with a ceramic core 88 which extends through the wax vane 86 from the radially outer end of the wax vane 86 to the radially inner end of the wax vane 86. Each ceramic core 88 extends out of and beyond the radially inner end of the corresponding wax vane 86. The radially inner end of each ceramic core 88 protrudes from the corresponding wax vane 86. A wax wall is wrapped around each ceramic core 88 protruding from a wax vane 86 and the wax wall is wax welded to the wax radially inner annular structure 82 to form the first portion 92 of the wax boss 90. A preformed wax boss is placed around the remaining portion of the radially inner end of each ceramic core 88 and adjacent to the wax wall and each preformed wax boss is wax welded to the wax wall to form the second portion 94 of each wax boss 90. The wax welding may comprise heating the mating surfaces of both of the wax parts and joining the wax parts by holding them together while the wax sets or by inserting a heated metal strip between the mating surfaces of both of the wax parts to melt the mating surfaces and then removing the metal strip to allow the wax to set or other suitable method known to those skilled in the art. The wax weld or wax joint is then smoothed.

The metal used to make the stator vane arrangement 30 may be a titanium alloy, steel or a nickel alloy.

The advantage of the present disclosure is that by positioning, e.g. building up, each wax boss on the respective ceramic core the positions of the wax bosses relative to the ceramic cores is controlled and hence any movement of a ceramic cores will result in a corresponding movement of the corresponding wax boss. Hence, the movement of the ceramic core does not result in a reduced thickness of the walls of the bosses around the passage after casting and final machining. Also, it enables the use of a ceramic core with a larger cross-sectional area and hence produces a passage within the vane with a greater cross-sectional area and thus provides a greater flow area for lubricant or air.

Although the present disclosure has referred to providing a ceramic core in a plurality of wax vanes it is equally possible to provide a ceramic core in at least one of the wax vanes, the ceramic core extending through the wax radially inner annular structure, providing a wax boss on the radially inner end of the ceramic core, the wax boss comprising a first portion having a first cross-sectional area and a second portion having a second cross-sectional area which is greater than the first cross-sectional area, and the first portion of the wax boss being positioned between and interconnecting the second portion of the wax boss and the wax radially inner annular structure, depositing a ceramic material on the wax pattern to form a ceramic mould, removing the wax from the ceramic mould, pouring molten metal into the ceramic mould, solidifying the molten metal within the ceramic mould to form the cast stator vane arrangement and removing the ceramic mould and ceramic core from the cast stator vane arrangement to form the stator vane arrangement.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A stator vane arrangement comprising a radially inner annular structure, a radially outer annular structure and a plurality of circumferentially spaced vanes extending radially between the radially inner annular structure and the radially outer annular structure, at least one of the vanes having a passage extending there-through from the radially inner annular structure to the radially outer annular structure, the radially inner annular structure having at least one boss extending radially inwardly there-from, the at least one boss having a passage extending there-through, the passage in the at least one boss being aligned with the passage in the at least one vane, the at least one boss comprising a first portion having a first cross-sectional area and a second portion having a second cross-sectional area which is greater than the first cross-sectional area, the first portion of the boss being positioned between and interconnecting the second portion of the boss and the radially inner annular structure, and the radially inner annular structure, the radially outer annular structure, the plurality of circumferentially spaced vanes extending radially between and secured to the radially inner annular structure and the radially outer annular structure and the at least one boss comprising a monolithic structure, wherein the or each boss having at least one support structure to support the boss, the at least one support structure extending radially from the second portion of the boss to the radially inner annular structure and the at least one support structure being connected to the first portion of the boss.

2. A stator vane arrangement as claimed in claim 1 wherein a plurality of vanes have a passage extending there-through from the radially inner annular structure to the radially outer annular structure, the radially inner annular structure having a plurality of bosses extending radially inwardly there-from, each boss having a passage extending there-through, the passage in each boss being aligned with a passage in a respective one of the vanes, each boss comprising a first portion having a first cross-sectional area and a second portion having a second cross-sectional area which is greater than the first cross-sectional area, and the first portion of each boss being positioned between and interconnecting the second portion of the boss and the radially inner annular structure, the radially inner annular structure, the radially outer annular structure, the plurality of circumferentially spaced vanes extending radially between and secured to the radially inner annular structure and the radially outer annular structure and the plurality of bosses comprising a monolithic structure.

3. A stator vane arrangement as claimed in claim 1 wherein the or each boss having a plurality of support structures to support the boss, each support structure extending radially from the second portion of the boss to the radially inner annular structure and each support structure being connected to the first portion of the boss.

4. A turbomachine comprising a stator vane arrangement, the stator vane arrangement comprising a radially inner annular structure, a radially outer annular structure and a plurality of circumferentially spaced vanes extending radially between the radially inner annular structure and the radially outer annular structure, at least one of the vanes having a passage extending there-through from the radially inner annular structure to the radially outer annular structure, the radially inner annular structure having at least one boss extending radially inwardly there-from, the at least one boss having a passage extending there-through, the passage in the at least one boss being aligned with the passage in the at least one vane, the at least one boss comprising a first portion having a first cross-sectional area and a second portion having a second cross-sectional area which is greater than the first cross-sectional area, the first portion of the boss being positioned between and interconnecting the second portion of the boss and the radially inner annular structure, and the radially inner annular structure, the radially outer annular structure, the plurality of circumferentially spaced vanes extending radially between and secured to the radially inner annular structure and the radially outer annular structure and the at least one boss comprising a monolithic structure, wherein the or each boss having at least one support structure to support the boss, the at least one support structure extending radially from the second portion of the boss to the radially inner annular structure and the at least one support structure being connected to the first portion of the boss.

5. A turbomachine as claimed in claim 4 wherein a bearing housing being secured to the radially inner annular structure and at least one bearing being arranged within the bearing housing.

6. A turbomachine as claimed in claim 5 wherein a lubricant supply is arranged to supply lubricant through the passage through the at least one of the stator vanes from the radially outer annular structure to the radially inner annular structure.

7. A turbomachine as claimed in claim 6 wherein a pipe is arranged to supply lubricant from the at least one boss to at least one bearing within the bearing housing.

8. A turbomachine as claimed in claim 5 wherein a lubricant collector is arranged to supply collected lubricant through the passage through the at least one of the stator vanes from the radially inner annular structure to the radially outer annular structure.

9. A turbomachine as claimed in claim 8 wherein a pipe is arranged to supply lubricant to the at least one boss from at least one bearing within the bearing housing.

10. A turbomachine as claimed in claim 5 wherein an air collector is arranged to supply collected air through the passage through the at least one of the stator vanes from the radially inner annular structure to the radially outer annular structure.

11. A turbomachine as claimed in claim 10 wherein a pipe is arranged to supply air to the at least one boss from at least one bearing within the bearing housing.

12. A turbomachine as claimed in claim 4 wherein an electrical cable extends through the passage through the at least one of the stator vanes from the radially inner annular structure to the radially outer annular structure.

13. A turbomachine as claimed in claim 12 wherein the electrical cable is arranged to supply an electrical signal from a speed probe.

14. A turbomachine as claimed in claim 5 wherein the at least one bearing rotatably mounting a shaft of the turbomachine.

15. A turbomachine as claimed in claim 14 wherein the turbomachine is a gas turbine engine.

16. A method of casting a stator vane arrangement comprising a radially inner annular structure, a radially outer annular structure and a plurality of circumferentially spaced vanes extending radially between the radially inner annular structure and the radially outer annular structure, at least one of the vanes having a passage extending there-through from the radially inner annular structure to the radially outer annular structure, the radially inner annular structure having at least one boss extending radially inwardly there-from, the at least one boss having a passage extending there-through, the passage in the at least one boss being aligned with the passage in the at least one vane, the at least one boss comprising a first portion having a first cross-sectional area and a second portion having a second cross-sectional area which is greater than the first cross-sectional area, and the first portion of the boss being positioned between and interconnecting the second portion of the boss and the radially inner annular structure, the radially inner annular structure, the radially outer annular structure, the plurality of circumferentially spaced vanes extending radially between and secured to the radially inner annular structure and the radially outer annular structure and the at least one boss comprising a monolithic structure, the method comprising producing a wax pattern of the radially inner annular structure, the radially outer annular structure and the plurality of circumferentially spaced vanes, providing a ceramic core in the wax pattern of at least one of the vanes, the ceramic core extending through a radially inner annular wall of the wax pattern, providing a wax boss on a radially inner end of the ceramic core, the wax boss comprising a first portion having a first cross-sectional area and a second portion having a second cross-sectional area which is greater than the first cross-sectional area, and the first portion of the wax boss being positioned between and interconnecting the second portion of the wax boss and the wax radially inner annular structure, depositing a ceramic material on the wax pattern to form a ceramic mould, removing the wax pattern from the ceramic mould, pouring molten metal into the ceramic mould, solidifying the molten metal within the ceramic mould to form the stator vane arrangement and removing the ceramic mould and ceramic core from the stator vane arrangement.

17. A method as claimed in claim 16 the radially inner annular structure, the radially outer annular structure, the plurality of circumferentially spaced vanes extending radially between and secured to the radially inner annular structure and the radially outer annular structure and a plurality of bosses of the stator vane arrangement comprising a monolithic structure, the method comprising providing a ceramic core in the wax pattern of a plurality of vanes, each ceramic core extending through a wax radially inner annular wall, providing a wax boss on a radially inner end of each ceramic core, each wax boss comprising a first portion having a first cross-sectional area and a second portion having a second cross-sectional area which is greater than the first cross-sectional area, and the first portion of the wax boss being positioned between and interconnecting the second portion of the wax boss and the wax radially inner annular structure, depositing a ceramic material on the wax pattern to form a ceramic mould, removing a wax from the ceramic mould, pouring molten metal into the ceramic mould, solidifying the molten metal within the ceramic mould to form the stator vane arrangement and removing the ceramic mould and the ceramic cores from the stator vane arrangement.

18. A method as claimed in claim 16 comprising providing at least one wax support structure to support the boss, the at least one wax support structure extending radially from the second portion of the wax boss to a wax radially inner annular structure and the at least one wax support structure being connected to the first portion of the wax boss.

19. A method as claimed in claim 18 wherein the boss having a plurality of wax support structures to support the wax boss, each wax support structure extending radially from the second portion of the wax boss to a wax radially inner annular structure and each wax support structure being connected to the first portion of the wax boss.

20. A stator vane arrangement comprising a radially inner annular structure, a radially outer annular structure and a vane extending radially between the radially inner annular structure and the radially outer annular structure, the vane having a passage extending there-through from the radially inner annular structure to the radially outer annular structure, the radially inner annular structure having a boss extending radially inwardly there-from, the boss having a passage extending there-through, the passage in the boss being aligned with the passage in the vane, the boss comprising a first portion having a first cross-sectional area and a second portion having a second cross-sectional area which is greater than the first cross-sectional area, the first portion of the boss being positioned between and interconnecting the second portion of the boss and the radially inner annular structure, and the second portion of the at least one boss having a circular cross section taken normal to the direction of the passage extending through the boss and defining the passage having an elongated cross sectional shape taken normal to the direction of the passage, wherein the or each boss having at least one support structure to support the boss, the at least one support structure extending radially from the second portion of the boss to the radially inner annular structure and the at least one support structure being connected to the first portion of the boss.

* * * * *